US008277279B2

(12) United States Patent
Pilkington

(10) Patent No.: US 8,277,279 B2
(45) Date of Patent: Oct. 2, 2012

(54) METHOD FOR PROCESSING A WORK-PIECE

(75) Inventor: Mark Iain Pilkington, Camby, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 933 days.

(21) Appl. No.: 12/331,851

(22) Filed: Dec. 10, 2008

(65) Prior Publication Data

US 2009/0156097 A1 Jun. 18, 2009

Related U.S. Application Data

(60) Provisional application No. 61/013,664, filed on Dec. 14, 2007, provisional application No. 61/019,041, filed on Jan. 4, 2008.

(51) Int. Cl.
*B24B 49/00* (2012.01)

(52) U.S. Cl. ..... 451/5; 451/11; 451/21

(58) Field of Classification Search ..... 451/5, 8, 451/11, 21; 700/164
See application file for complete search history.

(56) References Cited

U.S. PATENT DOCUMENTS

| | | | | |
|---|---|---|---|---|
| 2,102,518 | A | | 12/1937 | Johnson |
| 2,427,064 | A | | 9/1947 | Moul |
| 2,652,663 | A | | 9/1953 | Taylor |
| 3,403,480 | A | | 10/1968 | Robillard |
| 3,440,771 | A | | 4/1969 | Temple |
| 3,456,394 | A | | 7/1969 | Welsh |
| 3,798,845 | A | | 3/1974 | Stevens |
| 3,818,642 | A | * | 6/1974 | Seidel ..... 451/5 |
| 3,840,792 | A | | 10/1974 | Yokoe |
| 3,940,675 | A | | 2/1976 | Schroeder |
| 3,984,213 | A | | 10/1976 | Kelso |
| 4,007,411 | A | | 2/1977 | Saito |
| 4,023,084 | A | | 5/1977 | Owa |
| 4,051,636 | A | | 10/1977 | Heine |
| 4,061,952 | A | | 12/1977 | Dinsdale et al. |
| 4,213,277 | A | | 7/1980 | Fivian |

(Continued)

FOREIGN PATENT DOCUMENTS

JP 05057562 3/1993

(Continued)

OTHER PUBLICATIONS

Abrasive Technology, Advanced Plated CBN Grinding Technology, Sep. 1993, The Industrial Diamond Association of America, Inc., Windsor, Ontario, Canada.

(Continued)

*Primary Examiner* — Maurina Rachuba
(74) *Attorney, Agent, or Firm* — Krieg DeVault LLP

(57) ABSTRACT

A method for processing a work-piece is disclosed herein. The method includes the step of removing material from a work-piece to a predetermined depth with a tool that changes size. The method also includes the step of passing the tool across the work-piece in one or more passes during the removing step such that a cutting depth into the work-piece changes during a particular pass. Each pass is defined by a pass depth. The method also includes the step of maintaining a substantially constant chip thickness during the removing step. The method also includes the step of selectively maximizing one of a feed rate and a pass depth of material removal at the expense of the other during the removing step to minimize the time of the passing step.

19 Claims, 7 Drawing Sheets

U.S. PATENT DOCUMENTS

| | | | | |
|---|---|---|---|---|
| 4,471,580 | A * | 9/1984 | Robillard | 451/21 |
| 4,510,719 | A | 4/1985 | Yoneda et al. | |
| 5,174,068 | A | 12/1992 | Pickert | |
| 5,174,070 | A | 12/1992 | Losch et al. | |
| 5,331,770 | A | 7/1994 | Ichinohe et al. | |
| 5,643,055 | A | 7/1997 | Linzell | |
| 5,917,726 | A | 6/1999 | Pryor | |
| 6,030,277 | A * | 2/2000 | Shih et al. | 451/28 |
| 6,220,933 | B1 * | 4/2001 | Shih et al. | 451/28 |
| 6,415,191 | B1 | 7/2002 | Pryor | |
| 6,736,703 | B2 | 5/2004 | Osada et al. | |
| 7,258,594 | B2 | 8/2007 | Junker | |
| 7,955,159 | B2 * | 6/2011 | Heinz et al. | 451/5 |

FOREIGN PATENT DOCUMENTS

| | | |
|---|---|---|
| JP | 09314439 | 12/1997 |
| JP | 2002052444 | 2/2002 |
| JP | 2003071708 | 3/2003 |

OTHER PUBLICATIONS

AZOM Website, http:// www.azom.com/details.asp?ArticleID=3339, Jul. 2008.

Brinksmeier, E., Characterization of the size effect and its influence on the workpiece residual stresses in grinding, Oct. 2003, Foundation Institute of Materials Science, Bremen.

Kennedy, Bill, Calming Chatter, Jul. 2004, vol. 56, No. 7, Cutting Tool Engineering Magazine.

Kopac, J. et al., High-preformance grinding—A review, Journal of Materials Processing Technology 175 (2006) 278-284.

Norman, Peter, Advanced Process Monitoring and Analysis of Machining, Lulea University of Technology, 2006: 38.

PCT/US2008/086578 International Search Report and the Written Opinion dated Aug. 7, 2009.

* cited by examiner

METHOD FOR PROCESSING A WORK-PIECE

CROSS-REFERENCE TO RELATED APPLICATIONS

This application claims the benefit of U.S. Provisional Patent Application Ser. No. 61/013,664 for a GRINDING METHOD, filed on Dec. 14, 2007, and also claims the benefit of U.S. Provisional Patent Application Ser. No. 61/019,041 for a GRINDING CUT STRATEGY, filed on Jan. 4, 2008, and both applications are hereby incorporated by reference in their entireties.

BACKGROUND OF THE INVENTION

1. Field of the Invention

The invention relates to a method for processing a work-piece in which material is removed from the work-piece, such as by grinding for example.

2. Description of Related Prior Art

A work-piece can be processed in various ways in order to remove material. Material can be removed from a work-piece to form apertures, slots, grooves, or other features. Material can also be removed from a work-piece to produce a desired surface finish on the work-piece.

FIG. 1 is a schematic view of a material removal process according to the prior art. FIG. 1 shows a grinding wheel 10 having a periphery 12 with a radius represented by arrow 14. The radius can change during completion of the material removal process. In the prior art process, the grinding wheel 10 is passed over a work-piece 16 a plurality of times to change a shape/appearance of the work-piece 16. A line 18 in FIG. 1 represents the path taken by the periphery 12 of the grinding wheel 10 during a first pass across the work-piece 16. The material above the line 18 is removed from the work-piece 16 in the first pass. The thickness of the material removed during the first pass is represented by the arrow 20. The first pass can be viewed as a "rough" pass. Lines 22, 24, and 26 also represent paths taken by the periphery 12 of the grinding wheel 10 during successive passes. Each of these second, third and fourth passes can be viewed as a "rough" passes. The thicknesses of material removed during the second, third and fourth passes are represented by arrows 28, 30 and 32, respectively. Line 34 represents the path taken by the periphery 12 of the grinding wheel 10 during a fifth pass. The fifth pass can be viewed as a "semi-finish" pass. The thickness of the material removed during the fifth pass is represented by the arrow 36. The thickness of material removed during a semi-finish pass is less than the thickness of material removed during a rough pass. Line 38 represents the path taken by the periphery 12 of the grinding wheel 10 during a sixth pass. The sixth pass can be viewed as a "finish" pass. The thickness of the material removed during the sixth pass is represented by the arrow 40.

SUMMARY OF THE INVENTION

In summary, the invention is a method for processing a work-piece. The method includes the step of removing material from a work-piece to a predetermined depth with a tool that changes size. The method also includes the step of passing the tool across the work-piece in one or more passes during the removing step such that a cutting depth into the work-piece changes during a particular pass. Each pass is defined by a pass depth. The method also includes the step of maintaining a substantially constant chip thickness during the removing step. The method also includes the step of selectively maximizing one of a feed rate and a pass depth of material removal at the expense of the other during the removing step to minimize the time of the passing step.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF EXEMPLARY EMBODIMENTS

Figure 1:
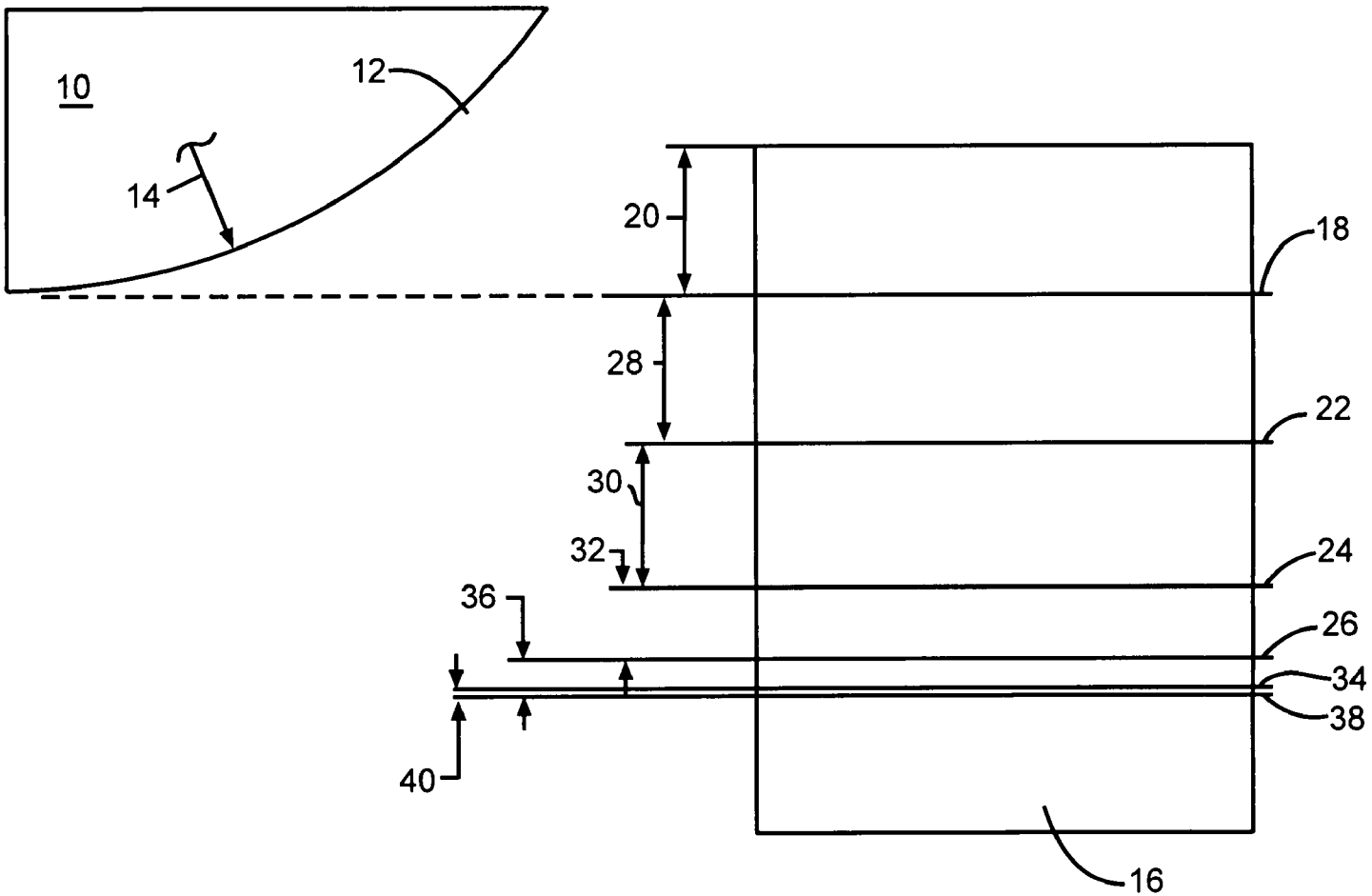
FIG. 1 Prior Art
FIG. 1 is a schematic view of a grinding cut strategy according to the prior art.

A plurality of different embodiments of the invention is shown in the Figures of the application. Similar method steps and structures are shown in the various embodiments of the invention. Similar method steps and structures have been numbered with a common reference numeral and have been differentiated by an alphabetic suffix. Also, to enhance consistency, the method steps and structures in any particular drawing share the same alphabetic suffix even if a particular method step or structures is shown in less than all embodiments. Similar method steps can be carried out similarly, produce similar results, and/or have the same purpose unless otherwise indicated by the drawings or this specification. Similar structures can be shaped similarly, operate similarly, and/or have the same function unless otherwise indicated by the drawings or this specification. Furthermore, particular method steps and/or structures of one embodiment can replace corresponding method steps and/or structures in another embodiment or can supplement other embodiments unless otherwise indicated by the drawings or this specification.

The invention is directed to a method for processing a work-piece and several exemplary embodiments of the invention are disclosed. The method includes the step of removing material from the work-piece to a predetermined depth with a tool that changes size. The predetermined depth can be the total depth of material to be removed from the work-piece. Alternatively, the predetermined depth can be the depth of material to be removed from the work-piece during a particular phase of material removal, such as roughing, semi-finishing, or finishing. The predetermined depth of material removal can be obtained by one pass or cut or multiple passes.

As used herein, "pass" and "cut" are used synonymously. Each pass involves removing material up to a "pass depth".

The predetermined depth will be a known value. For an embodiment of the invention in which one pass of the tool is made, the predetermined depth and the pass depth are equal. Alternatively, for an embodiment of the invention in which more than one pass of the tool is made, the predetermined depth can be the sum of the various pass depths.

The method also includes the step of passing the tool across the work-piece in one or more passes during the removing step such that a cutting depth into the work-piece changes. The cutting depth is the actual depth of penetration into the work-piece. The pass depth can be selected at the beginning of a pass and, at the beginning of a pass, the pass depth and the cutting depth are the same. However, towards the end of a pass, the cutting depth can change while the pass depth remains constant. This distinction will be described in greater detail below. The "instantaneous cutting depth" can be the cutting depth at any particular moment or time during the process. In other words, the instantaneous cutting depth can be viewed as the "current" cutting depth at some particular or instantaneous point during the process.

The removing and passing steps can be coextensive or can merely partially overlap. For example, in some exemplary embodiments of the invention, the removing step can include machine set-up and calculations occurring prior to the passing step. Alternatively, in some exemplary embodiments of the invention, the removing and passing steps can begin concurrently. Thus, the removing step can begin before or concurrent with the passing step and may end after the passing step has been completed or end at the same time as the passing step in various embodiments of the invention.

The method also includes the step of maintaining a substantially constant chip thickness during the removing step. Chip thickness is a non-dimensional value that correlates various parameters of material removal. For example, the following equation provides a value for chip thickness, "c":

$$c = \left( \frac{f \cdot \sqrt{d \cdot 200 \cdot \left( \frac{rw + rp}{rw \cdot rp} \right)}}{w \cdot 60} \right)$$

The value "d" represents the pass depth. For example, the arrows 20, 28, 30, 32 in FIG. 1 represent several different pass depths. The value "w" represents the rotational speed of the tool that changes size, such as a grinding wheel. The value "f" represents the feed rate. The value "rw" represents the radius of the grinding wheel. The value "rp" represents the radius of the work-piece being processed. For a linear cut, the radius of the work-piece is infinite and can either be approximated with a very large value or the equation can be simplified by removing the portion of the equation having the "rp" and "rw" terms and replacing it with 1/rw.

Chip thickness can also be determined based on a second equation:

$$c = \frac{MNIR}{sw}$$

The value "MNIR" is the maximum normal infeed rate and the value "sw" is the surface speed of the grinding wheel. MNIR can be determined from the following equation:

$$MNIR = \frac{f \cdot \sqrt{(rw)^2 - ((rw) - (d))^2}}{rw}$$

In the practice of various embodiments of the invention, the chip thickness can be selected initially and then the equations above can be applied to derive other dimensions, such as feed rate "f" and pass depth "d" for example.

Chip thickness can be selected based on previous experience with similar tools and/or materials, as well as previous experience with similar work-pieces. For example, one of ordinary skill can consider a chip thickness applied in a previously-performed process that is somewhat similar to a new process that is an embodiment of the invention. The previously-applied chip thickness and the equation in paragraph [0020] above can applied to derive a cutting depth and a feed rate.

If during running of the new process, thermal damage in the work-piece is observed during a first or subsequent pass of the embodiment, the chip thickness can be increased, the equation in paragraph [0020] above can applied to derive a new cutting depth and/or a new feed rate, and another pass can be attempted. This iterative process can be applied relatively few times until thermal damage is not observed. Similarly, if vibration in the grinding wheel is observed in a first or subsequent pass of the new process, the chip thickness can be decreased, the equation in paragraph [0020] above can applied to derive a new cutting depth and/or a new feed rate, and another pass can be attempted. This iterative process can be applied relatively few times until vibration is not observed.

The method also includes the step of selectively maximizing one of a feed rate and the pass depth at the expense of the other during the removing step to maximize the overall efficiency of material removal. The selectively maximizing step occurs during the removing step and thus occurs at run time. The selectively maximizing step can be carried out in several ways relative to the passing step. For example, the selectively maximizing step can be carried out prior to the passing step in an embodiment of the invention in which a single pass across the work-piece occurs. Alternatively, the selectively maximizing step can be carried out between passes of the passing step in an embodiment of the invention in which multiple passes across the work-piece are carried out. Alternatively, the selectively maximizing step can be carried out during a pass of the passing step in an embodiment of the invention in which a single pass across the work-piece occurs or an embodiment of the invention in which multiple passes across the work-piece are carried out.

In the prior art process shown in FIG. 1, the passes of the tool are shown schematically and generally indicate that more material is removed during rough passes. The pass depth of any particular pass is based on experimental practice, experience of the operator, and/or by trial and error. For a given operation, the series of passes is programmed initially and then carried out regardless of changes in the size of the grinding wheel.

Figure 2:
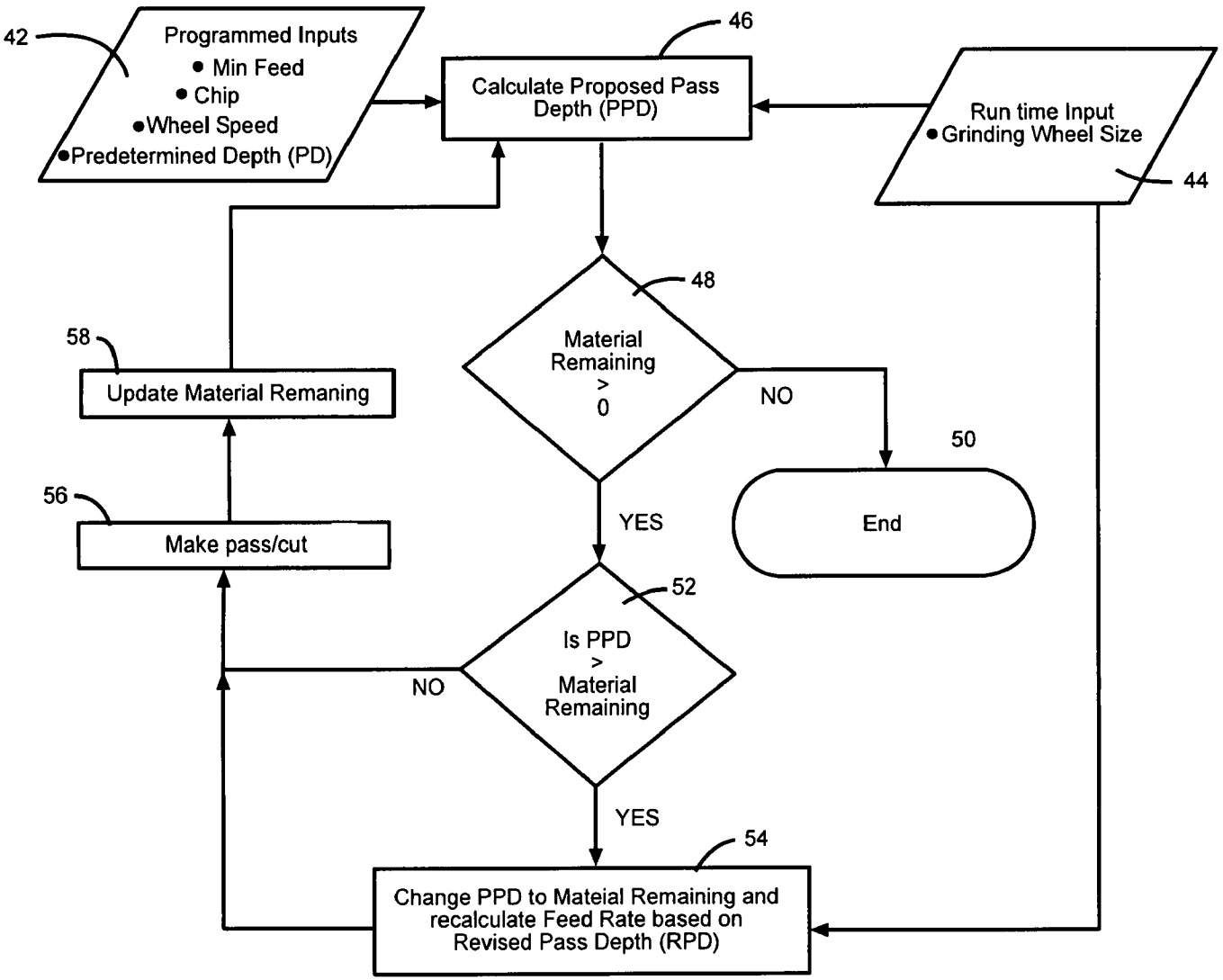
FIG. 2 is a simplified flow diagram illustrating a process according to a first exemplary embodiment of the invention.

A first embodiment of the invention is shown in FIG. 2 and can be applied to improve the efficiency of the material removal operation shown schematically in FIG. 1. In the first embodiment of the invention, material removal parameters can be selectively maximized for each of the three phases of material removal, roughing, semi-finishing and finishing. The specific number of passes within each phase can change based on calculations performed at run time.

At step 42 in FIG. 2, four values can be assigned/programmed to the machine controller: a minimum feed rate, a chip thickness, grinding wheel speed, and an amount of material remaining on the work-piece for removal (the predetermined depth). The minimum feed rate can be selected or established to avoid thermally damaging the work-piece. The initial minimum feed rate need not be determined from a mathematical equation, but can be selected based on conventional factors such as the material of the work-piece, the material of the grinding wheel, and the rotational speed of the grinding wheel. U.S. Pat. Nos. 2,427,064 and 5,174,068 provide teaching on avoiding thermal damage and are hereby incorporated by reference for said teaching. The chip thickness can be selected as set forth above. The chip thickness can remain substantially constant during the operation of the first exemplary embodiment of the broader invention. The speed of the grinding wheel can be selected based on the manufacturer's recommendation or based on prior experience.

At step 44, the size of the grinding wheel size can be assessed by the machine controller. The size of a grinding wheel will diminish over the course of its life, with increased numbers of grinding operations. The original size of the grinding wheel can be known and the size of the grinding wheel after some number of passes can be known by dressing the grinding wheel periodically between passes. This is done on a dressing device. The amount removed by the dressing device is controlled by a machine controller and is chosen to be more than the worst possible amount of wear that could occur up to that point in the life of the grinding wheel. The machine controller can maintain an accurate value for the loss of size of the grinding wheel so that the radius of the grinding wheel can be known throughout the material removal process. The size of the grinding wheel can also be assessed by actively monitoring the grinding wheel with a sensor communicating with the machine controller.

At step 46, the equation set forth above in paragraph [0020] can be rearranged and performed by the machine controller to determine the maximum value for the pass depth at the beginning of a first pass across the work-piece:

$$d = \left( \frac{c \cdot w \cdot 60}{f \cdot \sqrt{200 \cdot \left( \frac{rw + rp}{rw \cdot rp} \right)}} \right)^2$$

The pass depth derived from the equation in the paragraph above can be viewed as a "proposed" pass depth at the beginning of the first pass in the current phase of material removal. However, in steps subsequent to step 46, the machine controller can selectively maximize the feed rate at the expense of the proposed pass depth in order to maximize the efficiency of the grinding process.

At step 48, the machine controller can determine whether the depth of material remaining for removal is greater than zero. If not, all of the material to be removed from the work-piece has been removed and the exemplary process ends at step 50. In practice generally, this would generally be the result only after one or more passes. Also, prior to a first pass the material remaining would be equal to the predetermined depth. If the depth of material remaining for removal is greater than zero, the exemplary process continues to step 52 and the machine controller determines if the proposed pass depth calculated at step 46 is greater than the material remaining for removal from the work-piece during the present phase. In other words, step 52 confirms that the grinding wheel will not remove more material than desired in the upcoming pass if the calculated pass depth is applied.

If the proposed pass depth calculated at step 46 is greater than the material remaining for removal, the exemplary process proceeds to step 54. At step 54, the proposed pass depth calculated at step 46 is changed or "revised" to the value of the remaining material to be removed from the work-piece. In addition, the equation set forth above in paragraph [0020] can be rearranged and performed by the machine controller at step 54 to determine a new, maximized feed rate:

$$f = \left( \frac{c \cdot w \cdot 60}{\sqrt{d \cdot 200 \cdot \left( \frac{rw + rp}{rw \cdot rp} \right)}} \right)$$

In this equation, "d" is the revised pass depth. The new feed rate determined from the paragraph above will be greater than the minimum feed rate assigned at step 42 because the pass depth "d" has been reduced. Thus, in the first exemplary embodiment of the invention, the feed rate can be maximized at the expense of the pass depth.

If, at query step 52, the initially-proposed pass depth is not greater than the depth of remaining material to be removed from the work-piece, the process continues to step 56 and the grinding wheel is passed across the work-piece. If the process reaches step 56 from step 52, the pass is made to remove material up to the pass depth calculated at step 46 at the minimum feed rate assigned at step 42. The process also continues to step 56 from step 54. If the process reaches step 56 from step 54, the pass is made to remove the remaining material (the revised pass depth) at the higher-than-minimum feed rate derived at step 54.

At step 58, the amount of material to be removed from the work-piece is updated in view of the completion of step 56. In other words, the pass depth carried out at step 56 is subtracted from the predetermined depth. From step 58, the process returns to step 46 to potentially carry out another pass of the grinding wheel across the work-piece. The process can continue to step 46 and not step 48 to address a change in the size of the grinding wheel as a result of the previous pass or as a result of dressing the wheel after the previous pass. The flow diagram of FIG. 2 is not an endless loop, but the process can be repeating. If multiple passes are made, the actions for selectively maximizing one of the feed rate and the instantaneous cutting depth can be repeated between each pass.

In the practice of the first exemplary embodiment of the invention, when the grinding wheel is relatively large, fewer but deeper cuts can be taken on a work-piece, especially during the roughing phase. Also, if a particular phase can be completed in one pass the feed rate will be higher than in the conventional method. Conversely, when the grinding wheel is relatively small, a greater number of shallower cuts will be taken on the work-piece. If a phase can be completed in one pass the feed rate may be as low as the conventional method. Also, cut time can be longer than for a large wheel, but is still optimized.

In the first exemplary embodiment of the invention, the feed rate and the pass depth can be varied to maximize the rate of material removal, while avoiding thermal damage. When grinding cut strategies are based on a fixed pass depth and/or a fixed feed rate, the efficiency of the strategy is compromised. For example, in a grinding process where the grinding wheel is dressed to keep the correct form, the outer radius of the wheel can vary significantly between a new or substantially new wheel and a grinding wheel that has been dressed a plurality of times and is approaching its minimum size. The change in size of the grinding wheel can greatly affect the grinding process. Failing to take advantage of the fact that a grinding wheel can change in size means that parameters of the grinding cut strategies of the prior art were optimized for the worst case (small wheel) and, as a result, the efficiencies of the prior art grinding cut strategies were less than optimal for any other condition.

The first exemplary embodiment provides several advantages over the prior art. For example, the per-part cost can be reduced. By reducing the grinding cut time, the total cycle times will be reduced which will reduce the part cost. Grinding time is reduced because unnecessary and unproductive movement is reduced and/or eliminated. Also, capital cost can be reduced. The reduction in grinding time will allow each machine to perform more work. Depending on the load requirements, this may reduce the number of machines required. In addition, grinding capacity can be increased. For a given number of machines, the reduction in grinding time will allow more parts to be made in a set time period. Also, the invention can reduce the programming effort required of the operator. The feed rate, pass depth, and number of passes are automatically determined and need not be calculated by the programmer/operator. The grinding process according to the exemplary embodiment of the broader invention is more consistent, leading to a better understanding of preferred parameters, greater commonality between different parts, and shorter prove out times.

Two tables are set forth below and provide examples that demonstrate the advantages provided by the first exemplary embodiment of the invention. The dimensions and values in the tables are exemplary and not limiting on the first exemplary embodiment or the broader invention. The first table, immediately below, shows grinding time for two different sizes of wheel based on a conventional grinding process:

| | User Parameters | | | | | | | | | | |
|---|---|---|---|---|---|---|---|---|---|---|---|
| Cut | FEED (mm/min) | DOC | Desired Chip | Wheel speed (m/s) | PASS | Actual Feed (mm/min) | Cut Height (mm) | DOC (mm) | Actual Chip | Cut Length (mm) | Time (s) |
| | | | | | 120 mm dia. Wheel | | | | | | |
| 1 | 1000 | 2.00 | | 35 | 1 | 1000 | 5.50 | 2.00 | 1.23 | 100.0 | 6.0 |
| 2 | 1000 | 2.00 | | 35 | 2 | 1000 | 3.50 | 2.00 | 1.23 | 100.0 | 6.0 |
| 3 | 1000 | 2.00 | | 35 | 3 | 1000 | 1.50 | 2.00 | 1.23 | 100.0 | 6.0 |
| 4 | 1000 | 1.00 | | 35 | 4 | 1000 | 0.50 | 1.00 | 0.87 | 100.0 | 6.0 |
| 5 | 1300 | 0.45 | | 35 | 5 | 1300 | 0.05 | 0.45 | 0.76 | 100.0 | 4.6 |
| 6 | 1300 | 0.05 | | 35 | 6 | 1300 | 0 | 0.05 | 0.25 | 100.0 | 4.6 |
| | | | | | | | | | | TOTAL | 33.2 |
| | | | | | 220 mm dia. Wheel | | | | | | |
| 1 | 1000 | 2.00 | | 35 | 1 | 1000 | 5.50 | 2.00 | 0.91 | 100.0 | 6.0 |
| 2 | 1000 | 2.00 | | 35 | 2 | 1000 | 3.50 | 2.00 | 0.91 | 100.0 | 6.0 |
| 3 | 1000 | 2.00 | | 35 | 3 | 1000 | 1.50 | 2.00 | 0.91 | 100.0 | 6.0 |
| 4 | 1000 | 1.00 | | 35 | 4 | 1000 | 0.50 | 1.00 | 0.64 | 100.0 | 6.0 |
| 5 | 1300 | 0.45 | | 35 | 5 | 1300 | 0.05 | 0.45 | 0.56 | 100.0 | 4.6 |
| 6 | 1300 | 0.05 | | 35 | 6 | 1300 | 0 | 0.05 | 0.18 | 100.0 | 4.6 |
| | | | | | | | | | | TOTAL | 33.2 |

The second table, immediately below, shows grinding times for two different sizes of wheel based on the first exemplary embodiment of the invention:

| | User Parameters | | | | | | | | | | |
|---|---|---|---|---|---|---|---|---|---|---|---|
| Cut | FEED (mm/min) | DOC | Desired Chip | Wheel speed (m/s) | PASS | Actual Feed (mm/min) | Cut Height (mm) | DOC (mm) | Actual Chip | Cut Length (mm) | Time (s) |
| | | | | | 120 mm dia. Wheel | | | | | | |
| Rough | 1000 | 7.00 | 1.23 | 35 | 1a | 1000 | 5.50 | 2.00 | 1.23 | 100.0 | 6.0 |
| | | | | | 1b | 1000 | 3.50 | 2.00 | 1.23 | 100.0 | 6.0 |
| | | | | | 1c | 1000 | 1.50 | 2.00 | 1.23 | 100.0 | 6.0 |
| | | | | | 1d | 1414 | 0.50 | 1.00 | 1.23 | 100.0 | 4.2 |
| Semi-Finish | 1300 | 0.45 | 0.76 | 35 | 2 | 1300 | 0.05 | 0.45 | 0.76 | 100.0 | 4.6 |
| Finish | 1300 | 0.05 | 0.25 | 35 | 3 | 1300 | 0.00 | 0.05 | 0.25 | 100.0 | 4.6 |
| | | | | | | | | | | TOTAL | 31.5 |
| | | | | | 220 mm dia. Wheel | | | | | | |
| Rough | 1000 | 7.00 | 1.23 | 35 | 1a | 1000 | 3.83 | 3.67 | 1.23 | 100.0 | 6.0 |
| | | | | | 1b | 1049 | 0.50 | 3.33 | 1.23 | 100.0 | 5.7 |

-continued

| | User Parameters | | | | | | | | | | |
|---|---|---|---|---|---|---|---|---|---|---|---|
| Cut | FEED (mm/min) | DOC | Desired Chip | Wheel speed (m/s) | PASS | Actual Feed (mm/min) | Cut Height (mm) | DOC (mm) | Actual Chip | Cut Length (mm) | Time (s) |
| Semi-Finish | 1300 | 0.45 | 0.76 | 35 | 2 | 1764 | 0.05 | 0.45 | 0.76 | 100.0 | 3.4 |
| Finish | 1300 | 0.05 | 0.25 | 35 | 3 | 1741 | 0.00 | 0.05 | 0.25 | 100.0 | 3.4 |
| | | | | | | | | | | TOTAL | 18.6 |

The process time for a small grinding wheel is reduced by practicing the exemplary embodiment of the invention. This reduction in time is due to the last rough cut (1*d*), which applies a higher feed rate made possible because the pass depth is smaller than the other rough cuts. The process time for the large wheel is reduced by 44% compared to the traditional process by taking advantage of the capacity of the larger grinding wheel to take deeper rough cuts and faster finish and semi-finish cuts. A wheel size between the small and large examples will show a time saving in proportion to the wheel size. It is also noted that in these charts the semi-finish and finish phases are performed as a single pass; these phases could be performed with multiple passes at a higher feed rate. It is also noted that an additional set of conventional spark out passes with a nominally 0.0 (mm) pass depth can be added to the end of the process using fixed feed rates and no chip thickness calculation.

Figure 3:
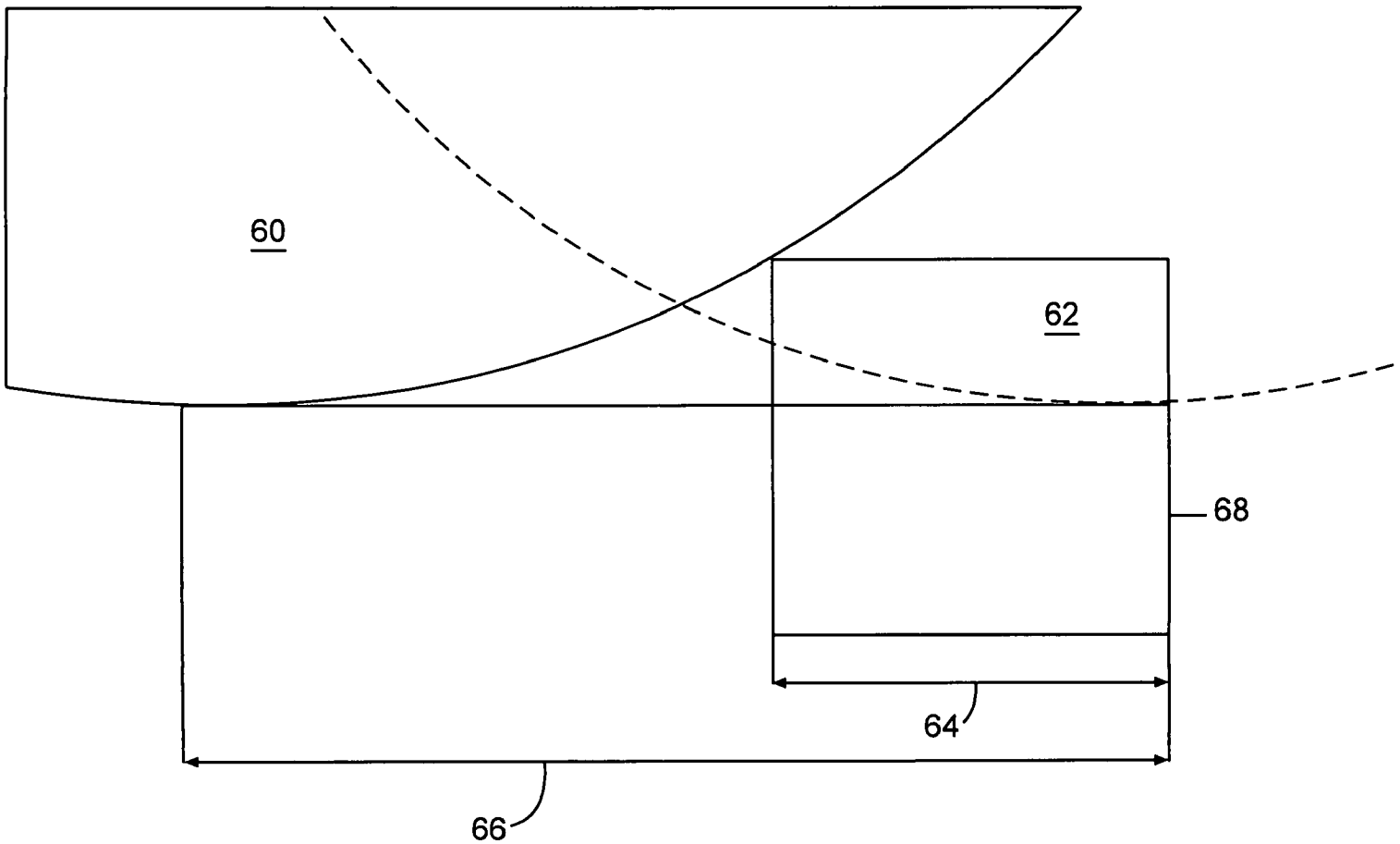
FIG. 3 is a schematic illustration of grinding wheel in position to begin a grinding operation according to a second exemplary embodiment of the invention.
Figure 4:
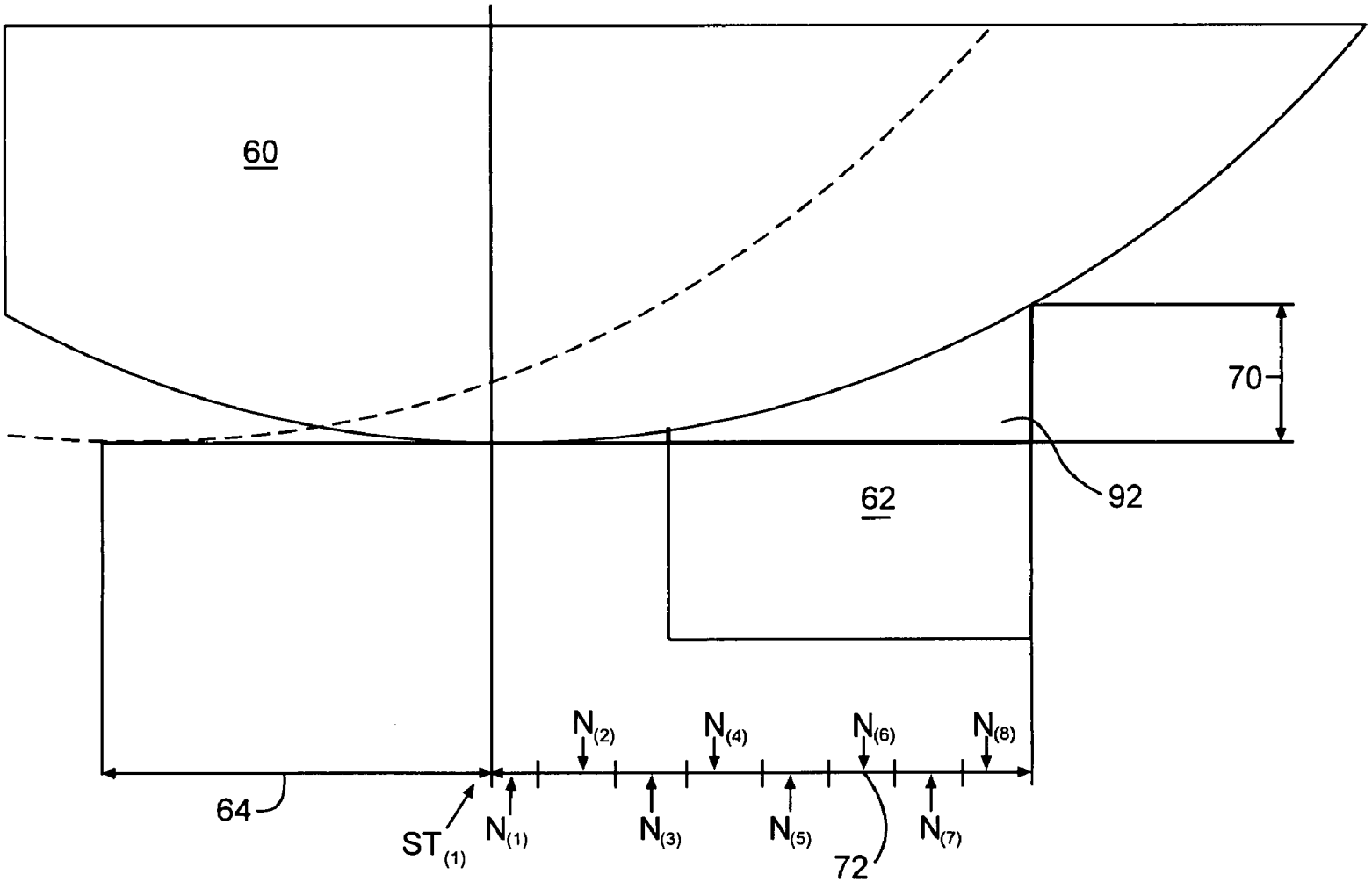
FIG. 4 is a schematic illustration of the grinding wheel shown in FIG. 3 after having progressed through a portion of the grinding operation.
Figure 5:
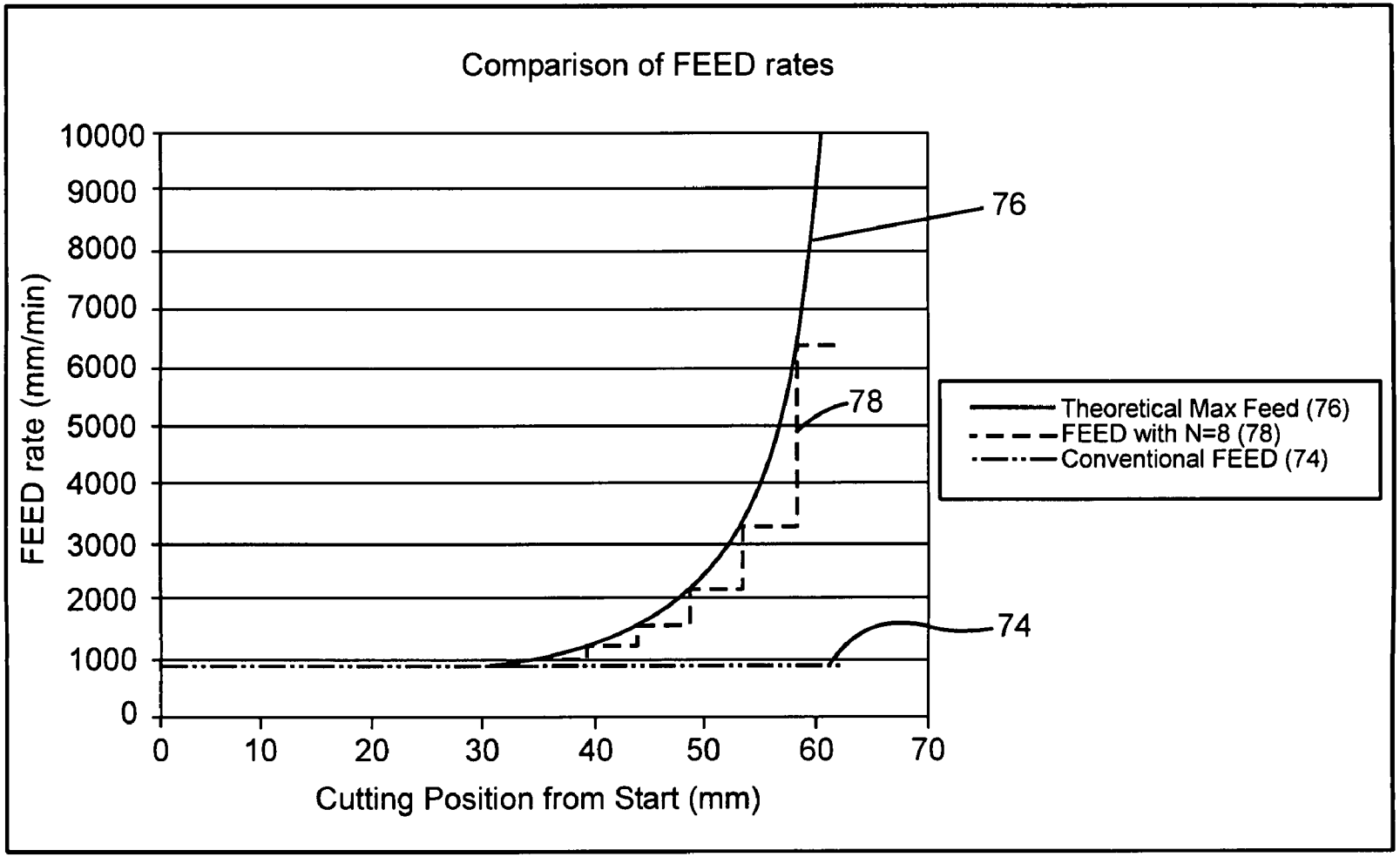
FIG. 5 is a graph comparing a prior art cutting methodology with two methodologies according to the second exemplary embodiment of the invention.

FIGS. 3-5 disclose a second embodiment of the invention in which one of the feed rate and the pass depth can be maximized during a pass of a tool that changes size. FIG. 3 shows a grinding wheel 60 in position to begin a grinding operation and remove material from a work-piece 62 having a thickness represented by arrow 64. The grinding wheel 60 traverses a total rectilinear distance represented by arrow 66. From the start point shown in FIG. 3 until the grinding wheel 60 first breaks an aft edge 68 of the work-piece 62, the grinding wheel 60 is cutting at the full pass depth. In other words, during this period of the pass, the pass depth and the cutting depth are equal. During this period of the cut, the grinding wheel 60 is cutting most aggressively. It this period of the cut or pass upon which an initial feed rate, an initial pass depth, and other parameters can be chosen by the programmer/operator. These initial values can be determined in a manner similar to the determination of these values set forth above with respect to the first exemplary embodiment.

In FIG. 4, the grinding wheel 60 is shown after having traversed a distance equal to the thickness 64. FIG. 2 also shows the pass depth represented by arrow 70. At the moment of the process shown in FIG. 4, the cutting depth is also represented by arrow 70. The grinding wheel 60 will continue to rectilinearly travel a distance to complete the cut. This remaining distance of grinding wheel travel is represented by the arrow 72. Up to this point in the cut, the cutting depth 70 has been constant and at its maximum value. After this point in the cut, the cutting depth 70 will progressively diminish. The pass depth can remain the same.

As the cutting depth drops, the pass becomes less aggressive and easier on the grinding wheel 60 if the feed rate does not change. The method according to the second exemplary embodiment of the invention seeks to exploit the full potential of the grinding wheel 60 over the full length of the cut, maintaining a maximum aggressiveness. The second exemplary method varies the feed rate during the pass, increasing the feed rate as the cutting depth decreases. Again, as explained above, the cutting depth will steadily decrease as the grinding wheel 60 moves rectilinearly along the distance represented by arrow 72.

The variation in the feed rate is accomplished in view of a constant chip thickness. The exemplary method varies the feed rate during the cut to maintain a substantially constant relative chip thickness to achieve a substantially constant level of aggressiveness during cutting. The chip thickness can be determined as set forth above.

In the second exemplary method, the point along the rectilinear distance of travel of the grinding wheel 60 at which cutting depth will begin to decrease can be determined using the formula:

$$s=\sqrt{rw^2-(rw-d)^2}$$

The value "d" is the pass depth. The value "s" is the distance represented by the arrow 72. The distance "s" can be divided into a plurality of segments or phases. Each phase or segment can be equal in length or have different lengths. Each segment can be assigned a distinct, maximized feed rate. The number of segments selected is directly related to the extent of savings that can be achieved in cutting time. A greater number of segments will save more time. However, on the other hand, a greater number of segments increases programming complexity. In a grinding operation where the grinding wheel 60 changes in size due to dressing and calculations must be performed at run time, it may be desirable to select a smaller number of segments. It has been found that eight segments may be desirable, however a different number of segments may be more desirable in other cutting operations. In FIG. 4, the arrow 72 has been divided into eight segments $N_{(1)}$-$N_{(8)}$, each with a respective starting point. An exemplary starting point $ST_{(1)}$ of the first segment $N_{(1)}$ is shown.

In the operation of the second exemplary embodiment of the broader invention, the feed rate can be the same as a conventional process during the first part of the cut. This first part of the cut is equal to the distance represented by arrow 64, equal to the thickness of the work-piece 62. FIG. 4 shows the end of the first part of the pass at $ST_{(1)}$. After the first part of the pass, a new feed rate can be selected in view of maintaining a constant relative chip thickness and in view of the diminishing cutting depth.

For each of segment or phase $N_{(1)}$-$N_{(8)}$, a feed rate can be determined by applying the equation set forth in paragraph [0039]. In applying that equation, the values for chip thickness "c", the rotational speed "w" of the tool that changes size, the radius "rw" of the grinding wheel, and the radius "rp" of the work-piece being processed can be the same values as applied for the first part of the pass. A revised pass depth "d" can be determined for each segment. In practice of the second exemplary embodiment, the cutting depth (the actual depth of material being removed from the work-piece) for any segment will be diminishing continuously over the segment. However, a single value for a revised pass depth in each segment can be assigned to simplify computations by the machine controller. The following formula can be used to determine a revised pass depth "d" for any particular segment $N_{(1)}$-$N_{(8)}$:

$$d(n)=rw-\sqrt{rw^2-s(n)^2}$$

In the equation immediately above, the value d(n) can be the revised pass depth applied in the equation set forth in paragraph [0039] to derive a feed rate for one of the segments. The value s(n) is the distance between the starting point ST(n) of the particular segment $N_{(1)}$-$N_{(8)}$ and the end of the cut or pass.

FIG. 5 is a chart comparing a prior art cutting methodology with two methodologies according to the invention. A line 74 represents a grinding process according to the prior art. A constant feed rate is applied throughout the length of cut. A line 76 represents the theoretical optimum feed rate based on maintaining a constant chip thickness. The grinding process shown by the line 76 would be enjoyed if the value "s"the distance represented by the arrow 72 in FIG. 4, is divided into an infinite number of segments. A line 78 represents an approximation of the optimum feed rate shown by the line 76. The line 78 is based on dividing the value "s", the distance represented by the arrow 72 in FIG. 4, into eight segments. Thus, eight different feed rates are applied during the grinding process represented by the line 78.

A table below illustrates a comparison between a process according to the prior art and the exemplary method of the invention. The exemplary method takes 73.3% of the time of the prior art process. The time saved by practicing the exemplary embodiment of the invention, or other embodiments, will vary depending on the specific parameters for a cut. For example, a light cut on a large piece can result in a 5% saving. A deep cut on a short part can result in a 40% saving.

| | Wheel radius rw (mm) | Depth of Cut d (mm) | Work Piece Length x (mm) | Cut Distance xc (mm) | Wheel Speed w (m/s) | Feed (mm/min) | Time (s) | Time as % of conventional (%) |
|---|---|---|---|---|---|---|---|---|
| Conventional | 75.0 | 10.0 | 25.0 | 62.4 | 50.0 | 871 | 4.30 | 100.0% |
| Varying feedrate | | 10.0 | | 25.0 | | 871 | 1.72 | |
| | | 10.0 | | 4.7 | | 871 | 0.32 | |
| | | 7.5 | | 4.7 | | 1,005 | 0.28 | |
| | | 5.4 | | 4.7 | | 1,181 | 0.24 | |
| | | 3.7 | | 4.7 | | 1,425 | 0.20 | |
| | | 2.4 | | 4.7 | | 1,790 | 0.16 | |
| | | 1.3 | | 4.7 | | 2,395 | 0.12 | |
| | | 0.6 | | 4.7 | | 3,601 | 0.08 | |
| | | 0.1 | | 4.7 | | 7,212 | 0.04 | |
| | | | TOTAL | 62.4 | | | 3.15 | 73.3% |

The invention, as shown by the operation of the second exemplary embodiment, provides several advantages over the prior art. For example, the per-part cost can be reduced. By reducing the grinding cut time, the operating times will be reduced which will reduce the part cost. Grinding time is reduced because unnecessary and unproductive movement is reduced and/or eliminated. Also, capital cost can be reduced. The reduction in grinding time will allow each machine to perform more work. Depending on the load requirements, this may reduce the number of machines required. In addition, grinding capacity can be increased. For a given number of machines, the reduction in grinding time will allow more parts to be made in a set time period. Also, the invention can lower consumable costs for continuous dress cuts because of shorter cutting times at a constant dress rate.

It is also noted that the first and second embodiments of the invention could be practiced together to further optimize the efficiency of material removal. For example the flow chart of FIG. 2 can be applied up to step 56 and the second exemplary embodiment of the invention can be carried out as a variation on step 56. In such an embodiment of the invention, the step of selectively maximizing one of the feed rate and the instantaneous depth of cut can occur between the one or more passes and can also occur during a pass.

Figure 6:
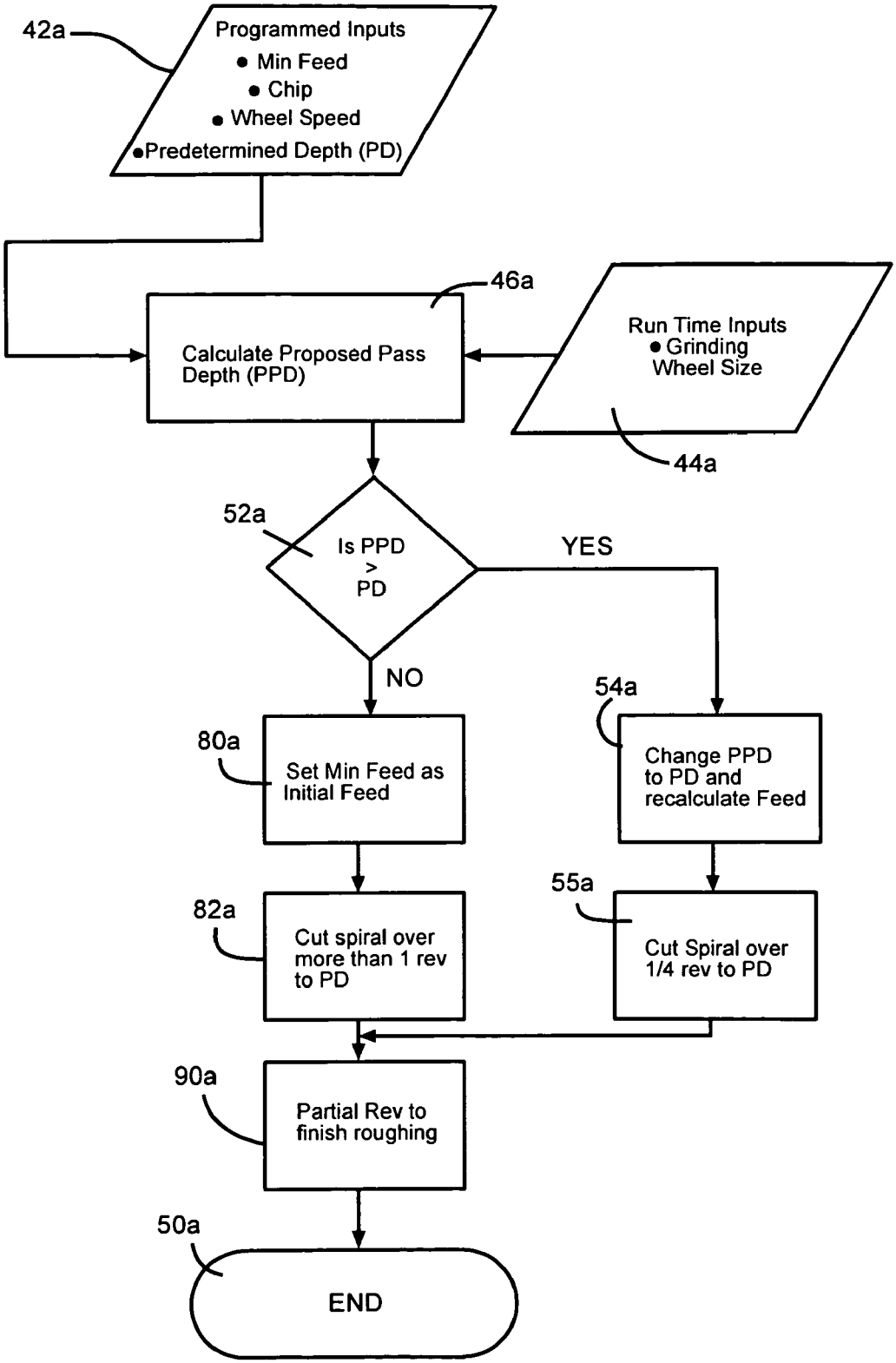
FIG. 6 is a simplified flow diagram illustrating a process according to a third exemplary embodiment of the invention.
Figure 7:
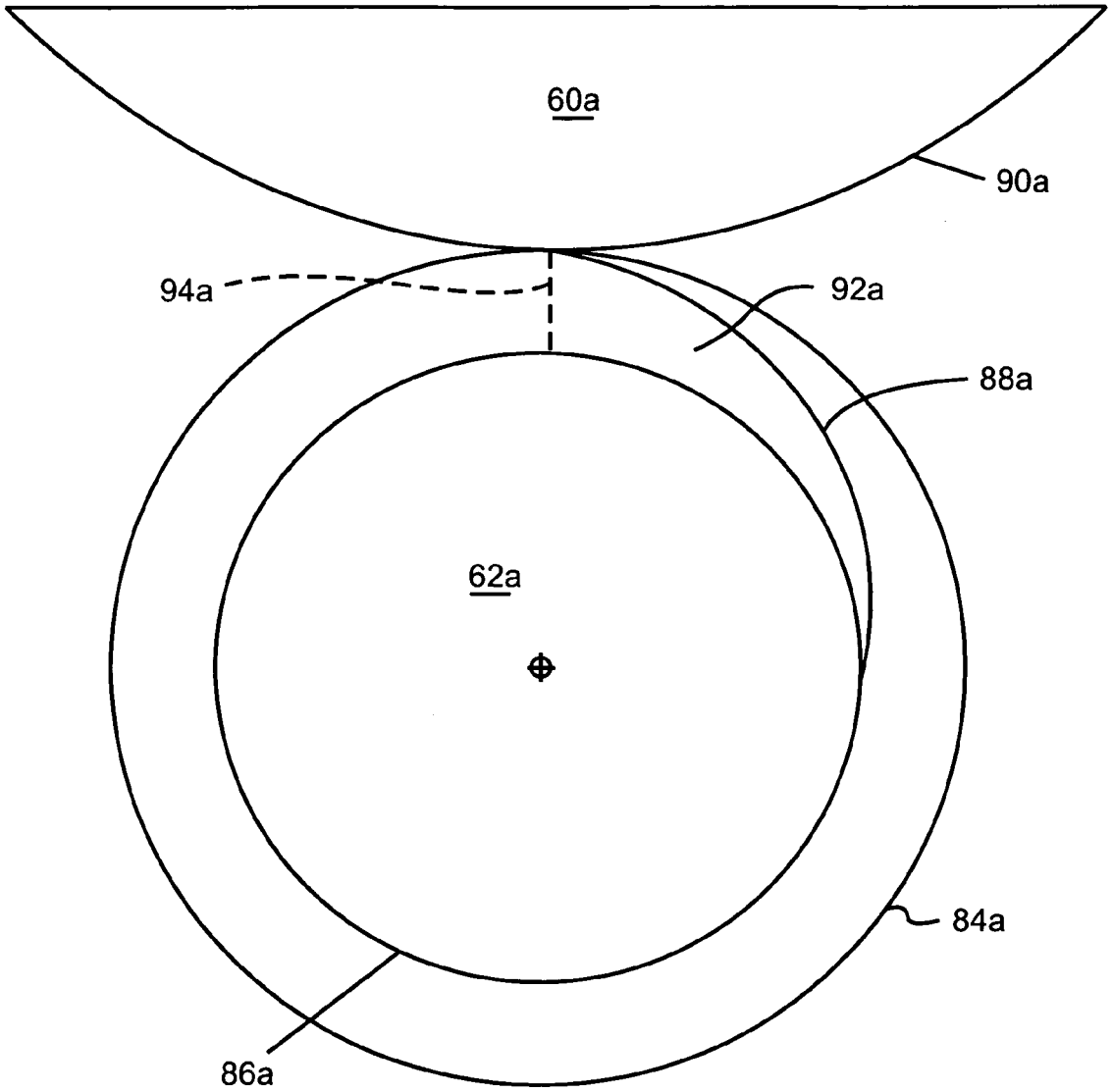
FIG. 7 is a schematic illustration of a grinding wheel beginning a cutting pass into a work-piece according to the third exemplary embodiment of the invention.

FIGS. 6 and 7 disclose a third embodiment of the invention in which one of the feed rate and the pass depth can be maximized during a pass of a tool that changes size. The third embodiment applies the invention to a spiral material removal operation rather than a linear operation as disclosed in the first and second embodiments. The third embodiment of the invention can improve the prior art by determining if it is possible to take a pass depth equal to the predetermined depth around the work-piece.

At step 42*a* in FIG. 6, four values can be assigned/programmed to the machine controller: a minimum feed rate, a chip thickness, grinding wheel speed, and an amount material remaining on the work-piece for removal (the predetermined depth). These values can be assigned as set forth above with respect to the first exemplary embodiment of the invention. The chip thickness can remain substantially constant during the operation of the third exemplary embodiment of the invention.

At step 44*a*, the size of the grinding wheel size can be assessed by the machine controller and can be accomplished similarly as in the first exemplary embodiment of the invention. At step 46*a*, the value for the pass depth for a first pass can be determined; the equation for this calculation is set forth above in paragraph [0035]. At step 52*a*, the machine controller can determine whether the proposed pass depth calculated at step 46*a* is greater than the predetermined depth. If so, the pass depth is revised/changed to the predetermined depth at step 54*a*. Also, a revised, increased feed rate is determined at step 54*a* based on the equation set forth above in paragraph [0039]. If the answer to the query at step 52*a* is negative, the minimum feed rate is selected for the feed rate of the spiral cut (at least initially) at step 80*a*. The spiral cut is completed over more than one revolution to the predetermined depth at step 82*a*.

After step 54*a*, the grinding wheel can be fed into the work-piece over a short angular distance to the predetermined depth at step 55*a*. FIG. 7 schematically shows a grinding wheel 60*a* and a work-piece 62*a*. A circle 84*a* represents the outer diameter of the blank or slug of the work-piece 62*a* and a circle 86*a* represents the outer diameter of the finished work-piece 62*a*. A line 88*a* represents the path followed by the periphery 90*a* of the grinding wheel 60*a* in reaching the predetermined depth. Based on the perspective of FIG. 7, the line 88*a* can start from the circle 84*a* at approximately the twelve o'clock position and reach the circle 86*a* at approximately the three o'clock position. These positions are set forth for explanation of the third exemplary embodiment and are not limiting on the embodiment or on the broader invention.

In the third exemplary embodiment of the invention, the grinding wheel 60*a* can reach the predetermined depth in one quarter of a revolution or less. In alternative operating environments, it may be desirable to reach the predetermined depth in more than one quarter of a revolution. In material removing operations involving a relatively large grinding wheel and a relatively small work-piece, the extent of the angular pass needed to reach the predetermined depth can be minimized.

Referring again to FIG. 6, the process according to the third exemplary embodiment of the invention can continue to step 90*a* from either of steps 55*a* or 82*a*. At step 90*a*, a partial revolution can be made to complete the rough phase of grinding. Referring additionally to FIG. 7, the step 90*a* can correspond to removing a portion 92*a* of material of the work-piece 62*a* bounded by circle 86*a*, line 88*a*, and a dashed line 94*a*. This portion 92*a* of material is analogous to a portion 92 of material shown in FIG. 4 in that the cutting depth (the actual depth of material being removed from the work-piece) will continuously diminish during removal of these two portions 92, 92*a* until completion of the material removal process. Therefore, another embodiment of the invention could combine the second and third exemplary embodiments disclosed herein. The path followed by the grinding wheel 60*a* to remove the portion 92*a* could be divided into a plurality of segments. The segments of the second exemplary embodiment are defined linearly and the segments of the third exemplary embodiment can be defined by angles or radians. The third exemplary embodiment ends at step 50*a*.

A processing operation according to the third embodiment of the invention with a small wheel can be generally similar to conventional process, but the differences will nonetheless result in an improvement to the efficiency of the operation. For example, generally, when the grinding wheel is relatively small, a greater number of revolutions by the grinding wheel 60*a* around the work-piece 62*a* can be taken but with a shallower depth than a larger grinding wheel. Furthermore, the feed rate will not go below the specified minimum feed rate and the chip thickness is constant. Following these general guidelines will lead to consistent performance and an easily understood process. Cut time can be longer than the large wheel, but the process is still improved over the prior art to a degree not expected. When a relatively larger wheel is used, generally, the pitch of the spiral will be greater, a deeper cut will be taken for each revolution of the part, and fewer revolutions will be taken.

The following table shows an example of improved grinding time for a range of wheel sizes making the same cut. Roughing times are shown for the different processes. As can be seen from the table, compared to a conventional process, the third exemplary embodiment of the invention is significantly faster.

| | Programmer Inputs | | | | | | Calculated values | | | | |
|---|---|---|---|---|---|---|---|---|---|---|---|
| Wheel dia. [mm] | Feed [mm/min] | DOC [mm] | Depth per rev [mm] | Desired Chip | Mn Feed [mm/min] | Wheel Speed [m/s] | Depth per rev [mm] | Actual Feed [mm/min] | Actual Chip | Revs | Time [s] |
| 1) Conventional | | | | | | | | | | | |
| Small (120 mm) | 1000 | 7 | 3 | | | 50 | 3.0 | 1000 | 1.155 | 3.3 | 377 |
| Mid (200 mm) | 1000 | 7 | 3 | | | 50 | 3.0 | 1000 | 0.942 | 3.3 | 377 |
| Large (300 mm) | 1000 | 7 | 3 | | | 50 | 3.0 | 1000 | 0.816 | 3.3 | 377 |
| V. Large (400 mm) | 1000 | 7 | 3 | | | 50 | 3.0 | 1000 | 0.816 | 3.3 | 377 |
| 2) New | | | | | | | | | | | |
| Small (120 mm) | | 7 | | 1.155 | 1000 | 50 | 3.0 | 1000 | 1.155 | 3.3 | 377 |
| Mid (200 mm) | | 7 | | 1.155 | 1000 | 50 | 4.5 | 1000 | 1.155 | 2.6 | 289 |
| Large (300 mm) | | 7 | | 1.155 | 1000 | 50 | 6.0 | 1000 | 1.155 | 2.2 | 245 |
| V. Large (400 mm) | | 7 | | 1.155 | 1000 | 50 | 7.0 | 1014 | 1.155 | 1.3 | 139 |

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for processing a work-piece comprising the steps of:

removing material from a work-piece to a predetermined depth with a tool that changes size;

passing the tool across the work-piece in one or more passes during said removing step such that a cutting depth into the work-piece changes during a particular pass, each pass defined by a pass depth;

maintaining a substantially constant chip thickness during said removing step; and selectively maximizing one of a feed rate and the pass depth of material removal at the expense of the other during said removing step to minimize the time of said passing step.

2. The method of claim 1 wherein said selectively maximizing step further comprises the steps of:

establishing a minimum feed rate to avoid thermally damaging the work-piece;

calculating a proposed pass depth based on said maintaining step and said establishing step; and comparing the proposed pass depth with the predetermined depth during said removing step.

3. The method of claim 2 wherein said selectively maximizing step further comprises the step of:

starting the one or more passes of said passing step at the minimum feed rate and at the proposed pass depth in response to said comparing step when the predetermined depth is greater than the proposed pass depth.

4. The method of claim 3 wherein said selectively maximizing step further comprises the steps of:

determining an initial feed rate greater than the minimum feed rate in response to said comparing step when the predetermined depth is less than the proposed pass depth; and initiating the one or more passes of said passing step at the initial feed rate and at the predetermined depth in response to said determining step.

5. The method of claim 4 wherein at least part of said selectively maximizing step occurs during said passing step.

6. The method of claim 5 wherein:

said passing step includes the step of moving the tool across the work-piece in a first pass, wherein the cutting depth into the work-piece decreases during less than all of the first pass; and said selectively maximizing step includes increasing the feed rate during the first pass from the first feed rate to a second feed rate greater than the first rate.

7. The method of claim 6 wherein said increasing step is further defined as:

increasing the feed rate a plurality of times during the first pass from the first feed rate to a plurality of feed rates greater than the first rate.

8. The method of claim 5 wherein said passing step is further defined as:

passing the tool across the work-piece in a single spiral pass during said removing step such that the cutting depth into the work-piece changes during the single spiral pass.

9. The method of claim 8 wherein said passing step further comprises the step of:

penetrating the work-piece to the predetermined depth in less than half of the single spiral pass.

10. The method of claim 4 wherein at least part of said selectively maximizing step occurs between the one or more passes of said passing step.

11. The method of claim 4 wherein at least part of said selectively maximizing step occurs between the one or more passes of said passing step and at least part of said selectively maximizing step occurs during said passing step.

12. The method of claim 1 further comprising the step of:

assessing a size of the tool and completing said selectively maximizing step in view of the size of the tool.

13. The method of claim 12 wherein said assessing step includes the step of:

monitoring a size of the tool during at least part of said removing step.

14. The method of claim 12 wherein said assessing step includes the step of:

predicting a size of the tool during at least part of said removing step.

15. A method for processing a work-piece comprising the steps of:

removing material from a work-piece to a predetermined depth with a grinding wheel that changes size;

passing the grinding wheel across the work-piece in at least one pass during said removing step such that a cutting depth into the work-piece during the at least one pass changes, each pass defined by a pass depth;

maintaining a substantially constant chip thickness during said removing step; and selectively maximizing one of a feed rate and the pass depth at the expense of the other during said removing step to minimize the time of said passing step.

16. The method of claim 15 wherein said selectively maximizing step further comprises the steps of:

establishing a minimum feed rate to avoid thermally damaging the work-piece;

assessing a size of the grinding wheel;

calculating a maximum value for the pass depth of one of the passes based on said maintaining step, said establishing step, and said assessing step;

comparing the maximum value of the pass depth with the predetermined depth;

starting at least one pass of said passing step at the minimum feed rate and at the maximum value of the pass depth if the predetermined depth is greater than the maximum value of the pass depth;

determining an initial feed rate greater than the minimum feed rate in response to said comparing step if the predetermined depth is less than the maximum value of the pass depth;

initiating at least one pass of said passing step at the initial feed rate and at the predetermined value if the predetermined depth is greater than the maximum value; and revising the predetermined value by subtracting the maximum value of the pass depth after said starting step.

17. The method of claim 15 wherein said selectively maximizing step includes the step of:

dividing the at least one pass into a plurality of discrete phases occurring sequentially with respect to one another, wherein each of the plurality of discrete phases is distinguished from one another with a different feed rate.

18. The method of claim 17 wherein said dividing step is further defined as:

dividing the at least one pass into a plurality of discrete phases occurring sequentially with respect to one another, wherein at least some of the plurality of discrete phases of the at least one pass share a common length across the work-piece.

19. The method of claim 15 wherein said passing step is further defined as:

passing the grinding wheel across the work-piece in a spiral pass extending over 360°, wherein the predetermined depth is reached in less than 180°.

* * * * *